United States Patent [19]

Danguy des Deserts et al.

[11] Patent Number: 4,797,034

[45] Date of Patent: Jan. 10, 1989

[54] OSCILLATING MARINE PLATFORM WITH A RIGID BASE

[75] Inventors: Loic M. J. Danguy des Deserts, Paris; François G. Sedillot, Velizy; Dominique Michel, Paris, all of France

[73] Assignee: Doris Engineering, France

[21] Appl. No.: 34,944

[22] Filed: Apr. 6, 1987

[30] Foreign Application Priority Data

Oct. 24, 1986 [FR] France ..... 86 14784

[51] Int. Cl.[4] ..... E02B 17/02

[52] U.S. Cl. ..... 405/202; 405/224; 405/227

[58] Field of Search ..... 405/195, 202, 204, 224, 405/227

[56] References Cited

U.S. PATENT DOCUMENTS 4,152,087 5/1979 Zaleski-Zamenhof et al. .... 405/195

4,175,890 11/1979 Taylor ..... 405/202

4,610,569 9/1986 Finn et al. ..... 405/202

4,621,949 11/1986 Marshall et al. ..... 405/202

4,696,603 9/1987 Danaczko et al. ..... 405/227

4,696,604 9/1987 Finn et al. ..... 405/227

4,705,430 11/1987 Nill ..... 405/227

*Primary Examiner*—David H. Corbin

*Attorney, Agent, or Firm*—Stevens, Davis, Miller & Mosher

[57] ABSTRACT

A platform comprising a deck supported by a tower composed of a rigid fixed structure of the jacket type anchored to the sea floor and of an oscillating structure supported by, and connected to, the fixed structure by flexible piles anchored in the lower part of the fixed structure an arranged on the periphery of the oscillating structure, and a shear device, the oscillating structure being equipped with a floater. The connection between the fixed and oscillating structures is located in a zone between 30 and 60% of the water depth from the water level.

13 Claims, 4 Drawing Sheets

2
12
4
II
II
1
IV
5
3
III
III
VI
7
11
8
V
7
6
6

10
92
9
91
10
5

5
11

7
8
6

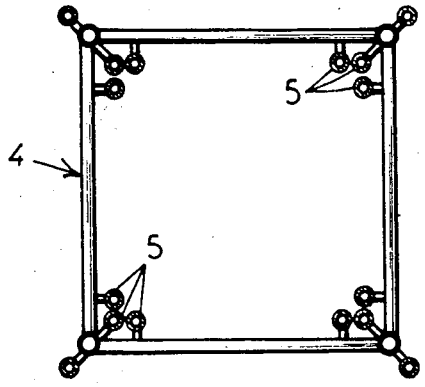
FIG.: 2
FIG.: 3
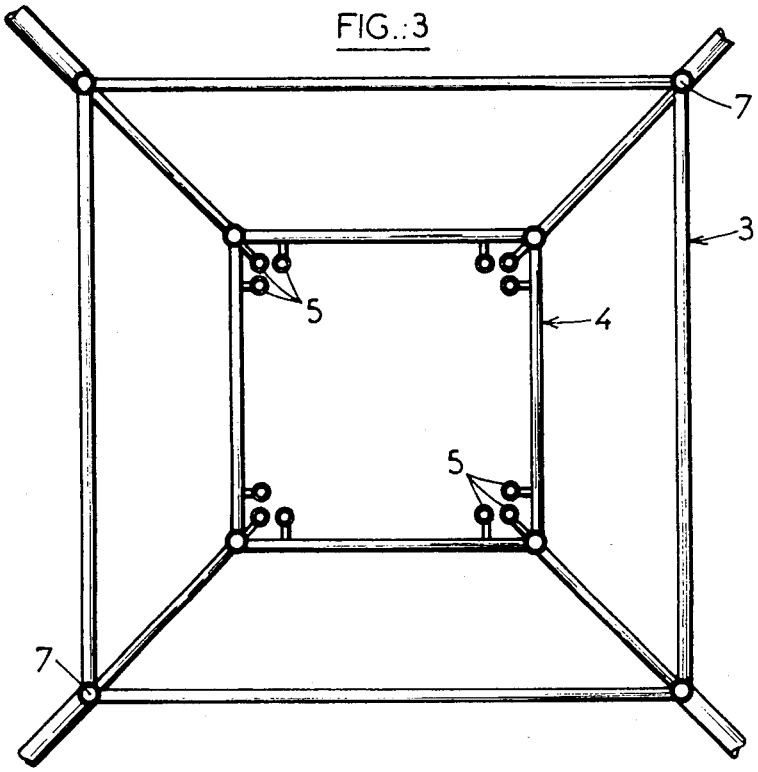

OSCILLATING MARINE PLATFORM WITH A RIGID BASE

The present invention relates to an oscillating marine platform for very deep waters having a fixed base connected to an associated oscillating part by flexible piles.

Constructing platforms, which support, for example, drilling equipment, for use in depths of water exceeding 300 meters requires new design structures.

Most of these designs are flexible structures, such as flexible towers which are articulated or guyed. When static or quasi-static forces, such as wind, current, or waves become very large these structures need large quantities of material which can even become prohibitively expensive. Thus, for example, when the current increases over the entire water depth, the resulting rotational moment generated from the ocean floor level increases, and it is accordingly necessary to increase the righting moment of the articulated structures or increase the rigidity of the flexible towers.

In the case of articulated towers, the righting moment can be increased by increasing the size of the floaters. However, increasing the size of the floaters also increases the current force generated, thus making an additional enlargement of the floaters necessary. By repeating this process a solution is theoretically possible, but requires such large quantities of steel that the technical feasibility of this approach is questionable.

In the case of guyed towers, such as those described in the U.S. Pat. No. 4,417,831, the effect of the current can be counteracted by a very substantial increase in the rigidity of the guys. However, this overall increase in the rigidity of the tower-guy system, without an increase in the mass of the system, results in a lowering of the natural period of the structure, which then approaches the range of the wave periods. To avoid resonance effects it would be necessary to increase the inertia of the structure to lengthen its natural period. Here again, to increase the inertia of the structure an increase in the dimensions of the guys is required with an associated increased quantities of steel and cost.

Where flexible towers, such as those described in the FR Pat. No. A-2,552,461, are concerned, the effect of the current is counteracted by an increase in the rigidity of the tower. This proportionately reduces the natural period of the structure which then comes within the range of the waves periods. To lengthen this natural period, it is therefore necessary to increase the dimensions of the floater located in the upper part of these towers. Dynamic forces generated in the flexible part of the tower then risk increasing, thereby making it necessary to make the tower even more rigid. If this approach converges to a solution, which may not happen, the quantities of material required are such that doubts again occur on the technical and economic feasibility of this approach.

The present invention makes it possible to reduce the above disadvantages arising from the static and quasi-static forces. This invention is based on the following reasoning: if there were no waves, that is to say no dynamic excitation, a fixed structure, for example of the "jacket" type in a metal trellis work, would be used because this structure best withstands the static forces.

However, when used in very deep waters, the natural period of this structure is within the range of the wave periods, and this results in substantial dynamic amplification. Installing a flexible structure above a fixed structure makes it possible to benefit from the respective advantages of each structure, without having their respective disadvantages. The flexible part installed in the upper zone, due to its dynamic response, makes it possible to filter the wave forces, while the fixed part located in the lower zone makes it possible to withstand the static forces effectively.

In the U.S. Pat. No. 4,610,569, the area of connection between the upper and lower parts of a comparable structure is located at a height of between 10 and 50% of the water depth, as measured from the bottom, resulting in the secondary natural periods of the structure of 7 seconds.

The intended object and the result of the present invention are different from those of the preceding patent, due in part because the areas of connection between the lower and upper parts has been chosen to reduce the total movements of the deck, while at the same time preserving a primary natural period of the structure greater than 20 seconds. This result is achieved by locating the area of connection of the upper and lower parts to a zone located between 40 and 70% of the water depth from the bottom.

A marine platform according to the present invention is a tower composed of a rigid fixed structure anchored to the sea floor and of an oscillating structure supported by the fixed structure and articulated on the fixed structure by a system comprising flexible piles and a shear device, the oscillating structure being equipped with a floater.

The explanations and Figures given below by way of example will make it possible to understand how the invention can be put into practice.

FIGS. 2 and 3 are sectional views along the respective lines II—II and III—III of FIG. 1;

Figures 1, 4, 5, 6:
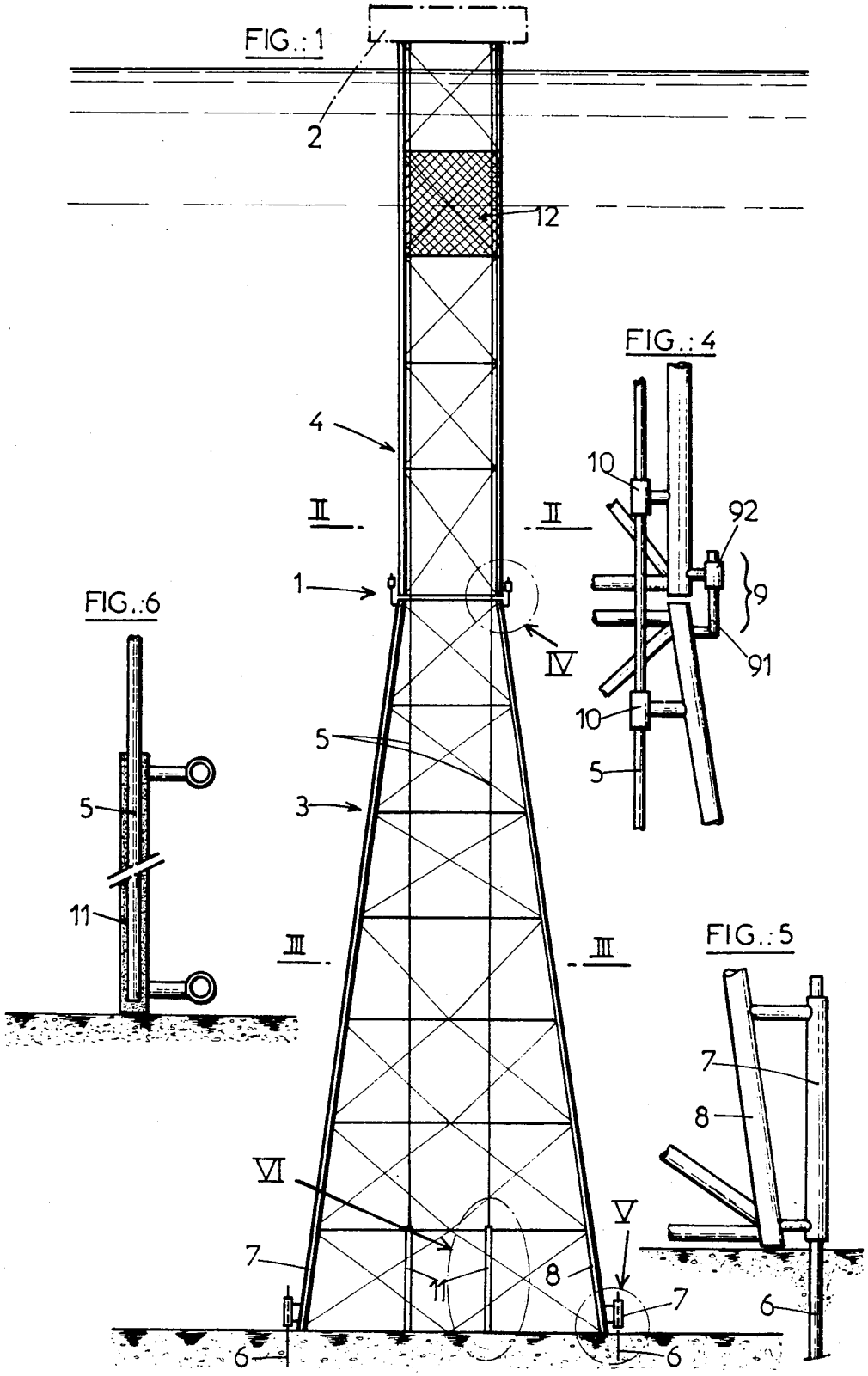
FIG. 1 is an elevation view of a platform according to the invention.
FIG. 4 is an enlarged view of the detail IV of FIG. 1, showing a first embodiment of a shear device.
FIG. 5 is an enlarged view of the detail V of FIG. 1.
FIG. 6 is an enlarged view, in longitudinal section, of the detail VI of FIG. 1.

The marine platform according to the present invention, as illustrated in FIG. 1, takes the form of a tower 1 supporting a deck 2, on which the drilling and production equipment is installed.

The tower is composed of two parts, a lower part which is a rigid fixed structure 3, for example of the "jacket" type in a metal trellis work, anchored to the sea floor, and an upper part which is an oscillating structure 4 for example of a metal trellis work. The oscillating structure is supported by the lower structure and is connected to the fixed structure 3 by means of a system of flexible piles 5 and a shear device 9.

The lower fixed structure transmits to the sea floor the reactions of the oscillating structure 4 and the current forces exerted directly on it. This structure is conventional and has a polygonal cross-section; which is square in this particular example. The fixed structure 3 is anchored by means of piles 6 which are buried into the sea floor and which are connected rigidly at their lower parts to guides 7 fixed to the legs 8 of the fixed structure (FIG. 5).

The oscillating structure 4 has flexible piles 5 and is connected to the fixed structure by means of the shear device 9 which will be described later.

The flexible piles are arranged on the periphery of the oscillating structure and are fixed rigidly to the upper part of the structure and, in the embodiment illustrated, are grouped at the corners of the structure. The piles are guided in sleeves 10 along the oscillating structure and then along the fixed structure, to which they are anchored rigidly to its lower part (FIGS. 2, 3 and 6). Accordingly length variations imparted to the piles as a result of the oscillations of the upper tower are distributed over a substantial length of the piles.

FIG. 6 shows the anchoring of a flexible pile in a sleeve 11 fastened to the lower end of the fixed structure. The pile can be fixed in the sleeve in a known way by grouting or by welding.

According to other embodiments, the flexible piles are fastened to the fixed structure at an upper level or are embedded in the sea floor.

The flexible piles 5 arranged on the periphery of the flexible structure ensure the stability of the oscillating structure by generating a righting moment equal to the product of the axial rigidities of the piles and the square of the distance to the geometrical center of the plane of rotation. In other words, the entire oscillating structure righting force can be imparted by these flexible piles, replacing the need for guys or floaters, as used in the prior art. The flexible piles also ensure that all the vertical forces generated in the structure are transmitted to the lower part.

The shear device 9 located at the lower part of the oscillating structure make it possible to transmit the shear forces and torques generated in the flexible structure to the lower fixed structure 3 and to minimize the transfer of axial forces and bending moments, thus not altering the oscillation of the upper part.

In the embodiment shown in FIG. 4, the shear device is composed of a set of shear pins 91 located at the upper end of the lower structure 3 which slide in the guide 92 of the upper structure, while at the same time preventing horizontal displacements.

Figure 7:
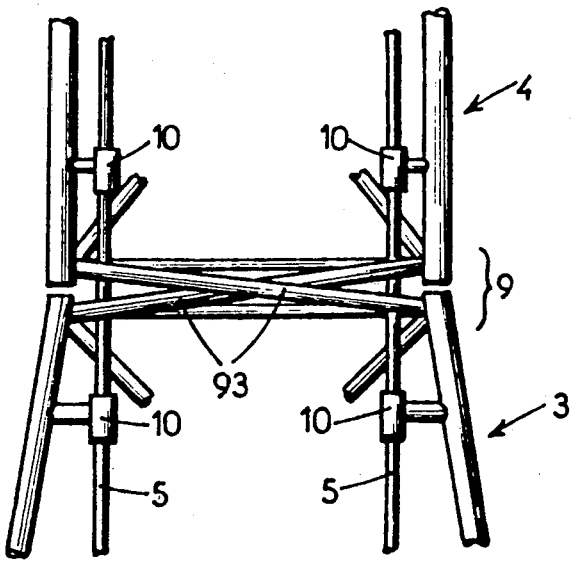
FIG. 7 is an elevation view of the detail IV of FIG. 1 showing a second embodiment of a shear device.
Figure 12:
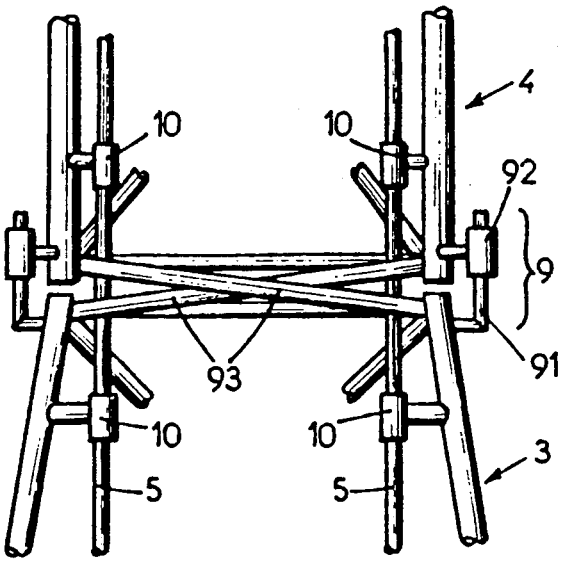
FIG. 12 is an enlarged view of the detail IV of FIG. 1, showing a combination of the first embodiment and the second embodiment of a shear device.
Figure 8:
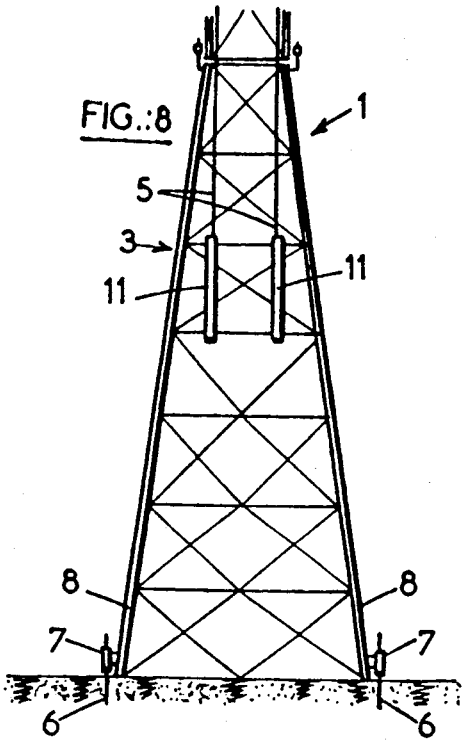
FIG. 8 is an elevational view of the rigid fixed structure wherein the flexible piles are fastened to said fixed structure at an upper level.
Figure 9:
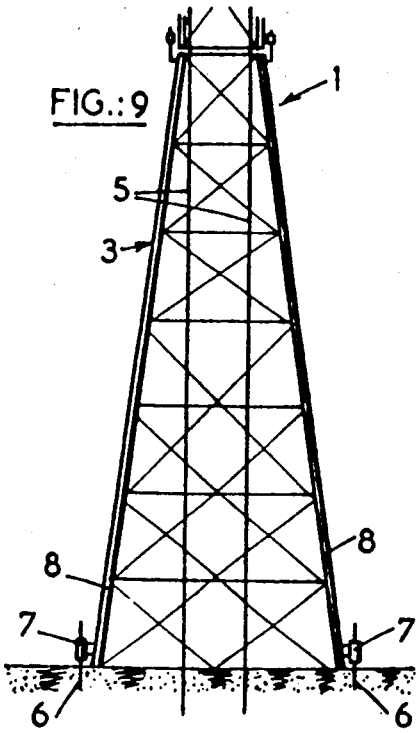
FIG. 9 is an elevation view of the rigid fixed structure wherein the flexible piles are embedded in the sea floor.
Figure 10:
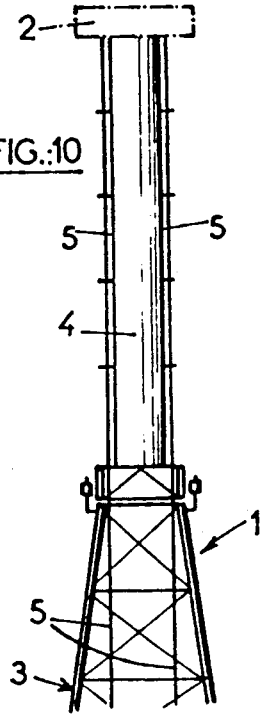
FIG. 10 is an elevation view of the oscillating structure composed of a metal shaft.
Figure 11:
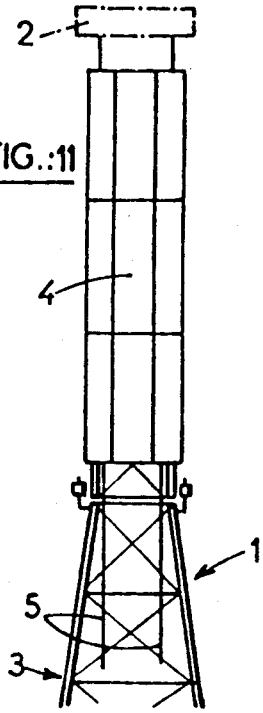
FIG. 11 is an elevation view of the oscillating structure composed of a multi-cellular structure made of concrete.

In another embodiment shown in FIG. 7, the shear device is composed of a set of structural elements 93 which link each side or each corner of the lower structure 3 to any of the opposite or adjacent sides or corners of the upper part 4. These elements may be of a tubular construction, connected on one end to a leg of the lower part, and on the other end to the adjacent legs of the upper part, these elements having a slenderness ratio such as to minimize the transfer of vertical forces and bending moments from the upper part to the lower part. Alternatively these structural elements 93 may consist of cables and slender beams, fixed or articulated at their extremities. The structural elements 93 limit the freedom of motion between the oscillating structure and the lower fixed structure, the motion being relative horizontal displacements and a relative rotation about vertical axis of the structures. Thus the overall shear force of torque generated in the oscillating structure and transmitted to the lower fixed structure result principally in axial force in the structural elements 93. In another embodiment shown in FIG. 12, the shear device is composed of a combination of the shear pins 91 and the guides 92 with the structural elements 93.

The rigidity of the flexible piles 5 is such that the total solid angle defined by the notion of the oscillating structure generates acceptable axial stresses in these piles. It may be necessary to reduce the axial stress in the piles by means of a floater 12. This element will have a shape which allows, on the one hand, the reduction of the apparent weight of the oscillating structure and, on the other hand, an increase of the natural period of oscillation. In some cases, where the buoyancy function of the floater is unnecessary, this element would only retain the function of increasing the natural period of oscillation.

The floater is located below the mean water level, and its upper end is in a zone between approximately 1/30 and 1/10 of the water depth and, in the example shown, approximately 25 m below the surface.

In the same example shown, the height of the fixed structure is greater than half the water depth and consequently greater than that of the oscillating structure, the limit between the lower and upper structures being in a zone located between 30 and 60% of the water depth from the water level.

A platform according to the invention, intended for a water depth of 600 meters in the chosen example, and withstanding currents of 2 m/s at the surface and 1 m/s at the sea floor, shows a gain in weight of the order of 37,000 tons of structural steel in comparison to a conventional oscillating platform. This gain represents 40 to 50% of the quantity of steel used.

According to embodiments shown, the fixed structure and/or the oscillating structure are composed of a metal shaft or of a multi-cellular structure made of concrete.

We claim:

1. An unguyed, free standing, segmented marine platform, for use in deep waters, comprising:

a fully submerged, fixed structure, having a polygonal cross-section and a plurality of substantially vertical legs, the fixed structure being anchored to the sea floor;

a substantially submerged, oscillating structure, positioned vertically above said fixed structure and having a polygonal cross-section and a plurality of substantially vertical legs which are in general vertical alignment with the legs of the fixed structure;

a connection means, for connecting the oscillating structure to the fixed structure, which is comprised of a plurality of flexible piles each having two ends, and of a plurality of pairs of cross structural members, the flexible piles being arranged on the periphery of the oscillating structure, the one set of ends of the respective piles being fastened to the oscillating structure and the opposing ends of the piles being fastened to the fixed structure, and the pairs of crossed structural members interconnecting legs of the oscillating structure to non-aligned legs of the fixed structure, and located in a zone from 30% to 60% of the water depth from water level; and a submerged floater, positioned on the oscillating structure, having its upper end located in a zone between 1/30 and 1/10 of the water depth from water level.

2. An unguyed, free standing, segmented marine platform, for use in deep waters comprising:

a fully submerged, fixed structure, having a polygonal cross-section and a plurality of substantially vertical legs, the fixed structure being anchored to the sea floor;

a substantially submerged, oscillating structure, positioned vertically above said fixed structure and having a polygonal cross-section and a plurality of substantially vertical legs which are in general vertical alignment with the legs of the fixed structure;

a connection means, for connecting the oscillating structure to the fixed structure, which is comprised of a plurality of flexible piles each having two ends, and of a plurality of interconnected guides and pins, the flexible piles being arranged on the periphery of the oscillating structure, the one set of ends of the respective piles being fastened to the oscillating structure and the opposing ends of the piles being fastened to the fixed structure, and the interconnected guides and pins, respectively, linking the oscillating structure to the fixed structure, and located in a zone form 30% to 60% of the water depth from water level; and a submerged floater, positioned on the oscillating structure, having its upper end located in a zone between 1/30 and 1/10 of the water depth from water level.

3. A platform as in claim 1, where the connection means also includes a plurality of interconnected guides and pins.

4. A platform as in claim 1, where the volume of the submerged floater is selected to make the oscillation of the oscillating structure greater than 18 seconds.

5. A platform as in claim 2, where the volume of the submerged floater is selected to make the oscillation of the oscillating structure greater than 18 seconds.

6. A platform as in claim 1, where at least one of the structures is a steel lattice structure.

7. A platform as in claim 2, where at least one of the structures is a steel lattice structure.

8. A platform as in claim 1, where at least one of the structures is a concrete, multi-cellular type.

9. A platform as in claim 2, where at least one of the structures is a concrete, multi-cellular type.

10. A platform as in claim 1, where at least one of the structures is of a metal shaft type.

11. A platform as in claim 2, where at least one of the structures is of a metal shaft type.

12. A platform as in claim 1, wherein at least one pair of crossed structural members interconnects adjacent sides of said oscillating structure to said fixed structure.

13. A platform as in claim 12, wherein said oscillating structure and said fixed structure are polygons having the same number of sides.

* * * * *